US008714546B2

(12) United States Patent
Saito

(10) Patent No.: US 8,714,546 B2
(45) Date of Patent: May 6, 2014

(54) PAPER DISCHARGE DEVICE

(71) Applicant: Tetsunori Saito, Tokyo (JP)

(72) Inventor: Tetsunori Saito, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/758,425

(22) Filed: Feb. 4, 2013

(65) Prior Publication Data

US 2013/0200567 A1 Aug. 8, 2013

(30) Foreign Application Priority Data

Feb. 7, 2012 (JP) ..... 2012-024285

(51) Int. Cl.
*B65H 31/00* (2006.01)

(52) U.S. Cl.
USPC ..... 271/209; 271/207; 271/314

(58) Field of Classification Search
USPC ..... 271/207, 209, 314
See application file for complete search history.

(56) References Cited

U.S. PATENT DOCUMENTS

| | | | | |
|---|---|---|---|---|
| 6,089,567 | A * | 7/2000 | Yatsuhashi et al. | 271/314 |
| 7,200,356 | B2 * | 4/2007 | Kawamoto | 399/405 |
| 8,235,383 | B2 * | 8/2012 | Masaki et al. | 271/188 |
| 8,408,538 | B2 * | 4/2013 | Miyazaki et al. | 271/188 |
| 2003/0007817 | A1 * | 1/2003 | Saitoh | 399/406 |

FOREIGN PATENT DOCUMENTS

| | | |
|---|---|---|
| JP | 2005-066900 A | 3/2005 |
| JP | 2007-137561 A | 6/2007 |

* cited by examiner

*Primary Examiner* — Kaitlin Joerger
(74) *Attorney, Agent, or Firm* — Manabu Kanesaka

(57) ABSTRACT

In an image forming apparatus, a paper discharge roller of a paper discharge unit has an upper roller as a driving roller and a lower roller as a driven roller. The lower roller has a nip roller which is fixed to a shaft and holds paper between the nip roller and the upper roller, and forming rollers having a diameter larger than that of the nip roller and arranged on both sides of the nip roller. Since a conveyance speed of the paper is constant, the number of revolutions of the forming roller having a large outer diameter is smaller than that of a nip roller having a small outer diameter. The friction between the forming roller and the paper is lower than that in conventional art. Attachment and accumulation of ink are suppressed, and inconvenience of contamination of the paper with ink upon paper discharge hardly occurs.

5 Claims, 4 Drawing Sheets

PAPER DISCHARGE DEVICE

TECHNICAL FIELD

The present invention relates to a paper discharge device having a pair of paper discharge rollers to form paper in a predetermined shape and discharge the paper by holding and conveying the paper, and more particularly, to a paper discharge device with a paper discharge roller having a structure where friction between paper and a roller having a large diameter at both ends, provided so as to form the paper in a predetermined shape, is low, and transfer of material attached to the paper to the roller is unlikely.

BACKGROUND ART

In an image forming apparatus, upon discharge of paper on which an image formation has been completed to the outside of the apparatus, especially in high-speed image formation, a phenomenon such as floatage of the end of discharged paper or downward curl of both side edges of the paper happens in some cases. Accordingly, in some cases, paper-discharge failure that the discharged paper does not arrive at a predetermined position on a paper discharge tray, or paper stacking failure that the discharged papers are not stacked in an appropriate state occurs.

To solve this problem, the inventors of the present invention invented a paper discharge roller as shown in FIGS. 5 and 6. The paper discharge roller shown in FIGS. 5 and 6 is not known upon submission of priority Japanese patent application the present application claims the benefit thereof. This paper discharge roller 100 is set in front of a paper discharge tray of an image forming apparatus, and it has an upper roller 101 as a driving roller and a lower roller 102 as a driven roller.

The lower roller 102 of the paper discharge roller 100 has a nip roller 103 in a cylindrical shape having a constant outer diameter, and forming rollers 104, 104, in a tapered shape where the outer diameter is increased outward, integrally provided at both outer end surfaces of the nip roller 103. In this manner, the lower roller 102 is a part where the nip roller 103 at the center and the forming rollers 104, 104 at the both outer sides are integrated, and is provided rotatably with respect to a driven shaft 105. The upper roller 101 as a driving roller, having approximately the same shape as that of the nip roller 103, is arranged above the nip roller 103 at the center of the lower roller 102.

Upon paper discharge, by holding and conveying paper between the upper roller 101 as a driving roller and the lower roller 102 as a driven roller, both side edges of the paper parallel to a conveyance direction are deformed to be floated upward along the forming roller 104 of the lower roller 102 having an outer diameter larger than that of the nip roller 103 and the upper roller 101, and the paper as a whole is formed in a wavy shape. With this forming, the paper has a strong body, and the discharged paper accurately arrives at a predetermined position on a paper discharge tray, or is stacked in an appropriate status on the paper discharge tray. That is, it has been considered that it is possible to prevent paper discharge failure and discharge paper stacking failure by improving floatage by forming the paper in a predetermined shape by holding and conveying the paper on which an image has been formed between the both rollers 101 and 102 so as to discharge the paper having a strong body.

However, when the inventor continued further research and development regarding the paper discharge roller 100 shown in FIGS. 5 and 6 proposed by the inventors, the inventors further found that the paper discharge roller had the following problems. That is, since the lower roller 102 has a shape where the outer diameter of the both ends is larger than that of the central part for the purpose of paper forming, when it is rotated as a part at the same number of revolutions upon paper holding and conveyance, the linear velocity of the forming roller 104 having a relatively large outer diameter is higher than that of the nip roller 103 having a relatively small outer diameter. Accordingly, since the forming roller 104 is brought in friction-contact with paper surface, when an image is formed in the corresponding part of the paper, image forming material such as ink is transferred from the paper to the forming roller 104 and accumulated there. Thereafter, when the paper on which the image formation has been completed is passed through the paper discharge roller 100, the ink or the like is retransferred to the paper and the paper is contaminated.

The inventions described in the following Patent Literatures 1 and 2, unlike the paper discharge roller 100 having the forming roller 104 as described above, relate to prevention of contamination of a general paper conveyance roller. The Patent Literature 1 discloses that an outer peripheral layer formed of microscopic particles or an outer peripheral layer formed of an ink repellent individual material is formed on a timing roller which may be contaminated with ink, so as to prevent attachment of ink and contamination of paper. Further, the Patent Literature 2 discloses that a large number of projections are uniformly formed on peripheral surfaces of driving roller and driven roller. When holding and conveying a print-completed sheet, the rollers and the sheet are almost in point-contact, so as to solve the problem of contamination of the roller.

Patent Literature 1: Japanese Published Unexamined Patent Application No. 2005-66900

Patent Literature 2: Japanese Published Unexamined Patent Application No. 2007-137561

According to the inventions described in the above-described Patent Literatures 1 and 2, the peripheral surface of the roller is processed so as to prevent attachment of ink. However, the effect of the process is gradually reduced in the course of use. Further, in the paper discharge roller proposed by the inventors of the present application, where the outer diameter at both ends is large to shape paper to have a strong body, the problem of likely attachment of ink to especially the large outer diameter forming part is not directly solved. Even when the process is applied to the paper discharge roller proposed by the inventors, which attains excellent paper discharge, it cannot be considered possible to attain some effect.

SUMMARY OF INVENTION

The present invention has an object to solve the problems as described above, and has another object to, in a paper discharge device, having a paper discharge roller where the outer diameter at both ends is large, capable of forming paper in a predetermined shape so as to attain excellent paper discharge, prevent attachment of ink or the like to forming rollers at both ends having a large outer diameter, and prevent occurrence of contamination of paper upon paper discharge.

A paper discharge device in claim 1 has a paper discharge roller including an upper roller and a lower roller, one of which is a driving roller. The lower roller has a nip roller, fixed to a shaft, that holds paper between the nip roller and the upper roller, and forming rollers, rotatable with respect to the shaft, having a diameter larger than that of the nip roller, arranged on both sides of the nip roller. By holding and conveying the paper between the upper roller and the lower roller, the paper is formed in a predetermined shape and is discharged.

Regarding the paper discharge device described in claim 2, in the paper discharge device according to claim 1, the nip roller has a cylindrical shape having an outer diameter which is substantially the same as that of the upper roller so as to convey the paper in cooperation with the upper roller, and a length of the nip roller in a direction orthogonal to the conveyance direction is longer or substantially the same as that of the upper roller. The forming roller has a tapered shape where an outer diameter is increased toward the outside so as to form a side edge of the paper in a raised shape while the paper is held and conveyed between the nip roller and the upper roller.

Regarding the paper discharge device in claim 3, in the paper discharge device according to claim 2, two sets of the paper discharge rollers, each set being formed with the upper roller and the lower roller, are provided with their axial lines corresponding with each other. The paper is deformed in a substantially W shape in a plane orthogonal to a paper conveyance direction and discharged by holding and conveying the paper between the two sets of the paper discharge rollers.

According to the present invention, the lower roller to hold and convey paper so as to form both side edges of the paper in a predetermined shape has the comparatively small-diameter nip roller at the center and the comparatively large-diameter forming rollers at the both ends. These rollers are separated from each other and are individually rotatable. Note that since paper conveyance speed of the held and conveyed paper is constant and the linear velocity of the paper with respect to the nip roller and that with respect to the forming rollers is the same, the number of revolutions of the forming roller with the relatively-large outer diameter is smaller than that of the nip roller with the relatively-small outer diameter. Accordingly, the friction between the forming roller and the paper is lower in comparison with conventional art. The attachment and accumulation of ink or the like to the forming roller are suppressed. Thus the occurrence of inconvenience of contamination of the paper with ink or the like upon paper discharge is unlikely.

DESCRIPTION OF EMBODIMENTS

An embodiment of the present invention will be described with reference to FIGS. 1 to 4.

1. Entire Structure of Image Forming Apparatus (FIG. 1)

An image forming apparatus 1 in the present embodiment, having plural ink-jet heads to discharge different color inks, is capable of color image formation. Further, as described later, the image forming apparatus is capable of single-sided printing and double-sided printing to form images on both front and rear surfaces of paper. Further, upon discharge of paper where an image is formed on single or both surfaces, whether one surface is to be faced up or faced down, i.e., the surface of the paper to be faced up upon discharge, is arbitrarily selected.

Figure 1:
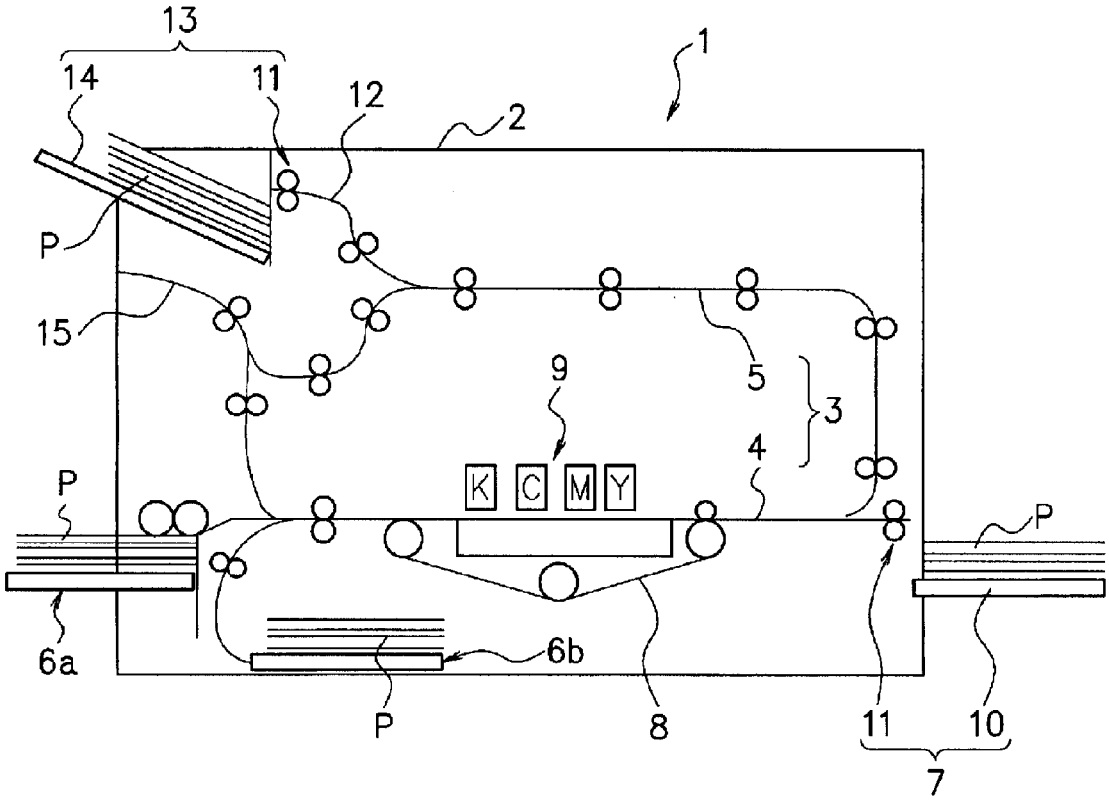
FIG. 1 A diagram schematically showing a configuration of an image forming apparatus according to an embodiment of the present invention.

As shown in FIG. 1, an approximately looped conveyance passage 3 where paper P is conveyed is set in a case 2 of the image forming apparatus 1. This looped conveyance passage 3 is divided into a lower side main conveyance passage 4 for image formation and an upper side reverse conveyance passage 5 for reversal of the paper where image formation has been made on its front surface and return the paper with its rear surface faced up to the main conveyance passage 4.

As shown in FIG. 1, the main conveyance passage 4 is a passage on the lower side. It is horizontally provided between an external paper supply unit 6*a* provided in one side part of the case 2 or an internal paper supply unit 6*b* provided inside the case 2 in the vicinity of the external paper supply unit 6*a* and a first paper discharge unit 7 as a paper discharge device provided in another side part of the case 2. The center of the main conveyance passage 4 is formed with a belt conveyance mechanism 8 as a conveyance unit, and front and rear parts of the belt conveyance mechanism 8 are formed with guide members.

In the main conveyance passage 4, above the belt conveyance mechanism 8, as an image forming means, four ink-jet apparatus 9 to discharge K (black), C (cyan), M (magenta) and Y (yellow) color inks, are arrayed along a paper conveyance direction. A desired color image is formed by discharging ink to paper sent with the belt conveyance mechanism 8.

The first paper discharge unit 7 has a paper discharge tray 10 provided on an outer surface of the other side of the case 2 and a paper discharge roller 11 provided in front of the paper discharge tray 10 in the case 2. The first paper discharge unit 7 discharges paper, where an image has been formed with the ink-jet apparatus 9 on its upper surface, in a state where the upper surface is directed upward (faced up), onto the paper discharge tray 10.

The paper discharge roller 11 has a function of forming paper in some shape and discharging the paper. The structure therefor will be described later.

As shown in FIG. 1, the reverse conveyance passage 5 is a passage formed with the guide members provided on the upper side of the main conveyance passage 4. It is a looped passage which branches via a passage selection means (not shown) from the downstream of the ink-jet apparatus 9 in the main conveyance passage 4. The branches return to the upstream side of the main conveyance passage 4 and join there.

A paper discharge passage 12 branches diagonally upward from a midpoint of the reverse conveyance passage 5, and its rear end is connected with a second paper discharge unit 13 which is a paper discharge device provided in the case 2. The second paper discharge unit 13 has a sloped paper discharge tray 14 provided, with its front side raised, in the case 2, and the paper discharge roller 11 provided in front of the paper discharge tray 14 in the case 2. The second paper discharge unit 13 discharges the paper where an image has been formed on its upper surface with the ink-jet apparatus 9, in a state where the upper surface is directed downward (faced down), onto the paper discharge tray 14.

The paper discharge roller 11 has the same structure as that of the paper discharge roller 11 of the first paper discharge unit 7, and will be described later in detail.

At a midpoint of the reverse conveyance passage 5, a reverse unit 15 branches from a position between the paper discharge passage 12 and the external paper supply tray 6*a*. The reverse unit 15 has a dead end structure. Although the details of the structure are not shown, in a midpoint of the passage, plural conveyance rollers are provided at arbitrary intervals. According to this structure, it is possible to reverse the front/rear side of the paper by reciprocating the print-completed paper, guided from the main conveyance passage 4 to the reverse conveyance passage 5, with the reverse unit 15. That is, it is possible to return the paper, with the printed front surface as the lower side while the unprinted rear surface as an upper side, to the main conveyance passage 4.

As described above, according to the image forming apparatus 1 in the present embodiment, when the paper is conveyed from the external paper supply tray 6*a* or the internal paper supply tray 6*b* along the main conveyance passage 4, then an image is formed on the paper with the ink-jet apparatus 9, and the paper is discharged from the first paper discharge unit 7, it is possible to discharge the paper in a state where the image forming surface is faced up. When this image-formation completed paper is not discharged from the first paper discharge unit 7 but the paper is guided to the reverse conveyance passage 5, and the paper is discharged from the paper discharge passage 12 to the second paper discharge unit 13, it is possible to discharge the paper with its image forming surface is faced down. Further, when the paper where an image formation has been made on its front surface is not discharged from the first paper discharge unit 7 but the paper is guided to the reverse conveyance passage 5, then the front/rear side is reversed by reciprocation with the reverse unit 15, and an image is formed on the rear surface (upper surface) of the paper with the ink-jet apparatus 9 while the paper is conveyed along with the main conveyance passage 4 again, it is possible to realize double-sided printing. In this case, the paper may be discharged from the first paper discharge unit 7. Otherwise, when the paper is discharged from the second paper discharge unit 13, it is possible to reverse the upper/lower side of the paper from that in a case where the paper is discharged from the first paper discharge unit 7.

2. Structure of Paper Discharge Roller (FIGS. 2 to 4)

According to the image forming apparatus 1 in the present embodiment, the respective paper discharge rollers 11 in the first paper discharge unit 7 and the second paper discharge unit 13 realize excellent paper discharge and paper discharge stacking by forming the paper in a predetermined shape upon paper discharge. Further, since attached ink is hardly transferred to the paper, the contamination of the paper is unlikely.

Figure 2:
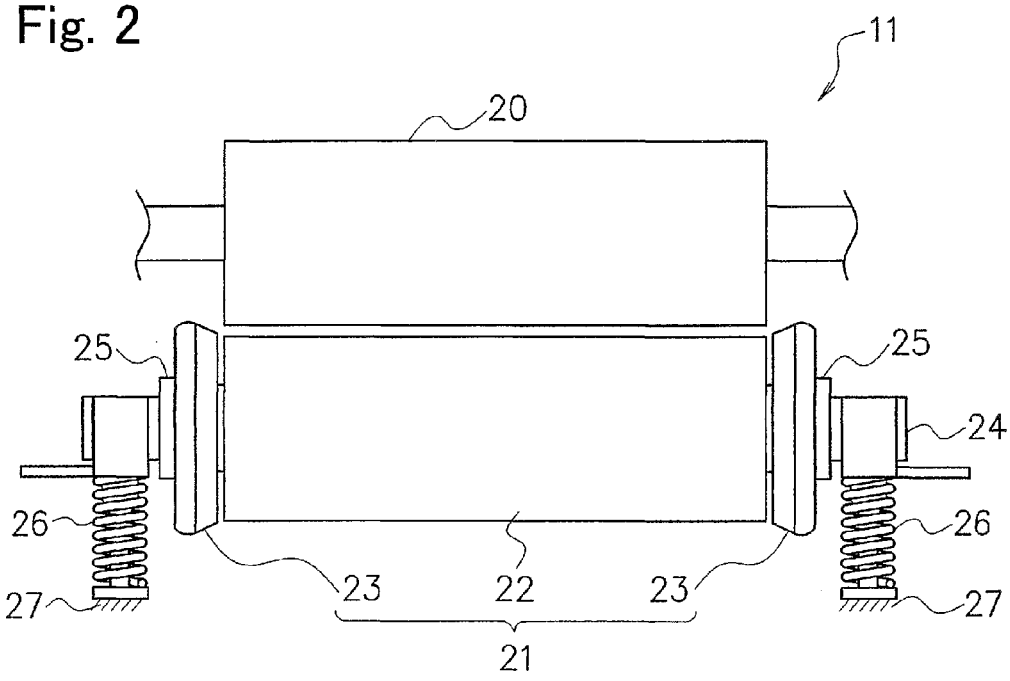
FIG. 2 A front view of a lower roller of a paper discharge roller according to the embodiment of the present invention.
Figure 3:
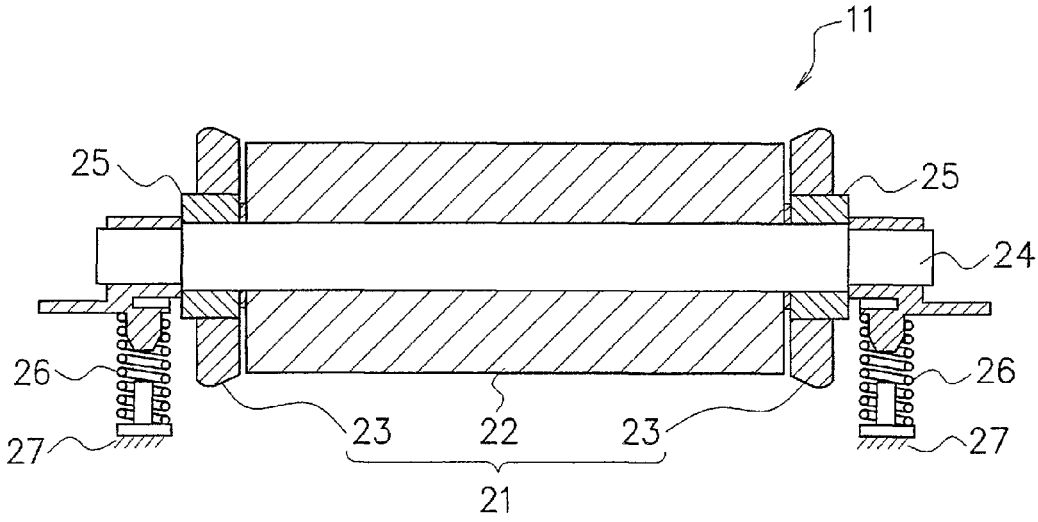
FIG. 3 A cross-sectional view showing the lower roller of the paper discharge roller according to the embodiment of the present invention.
Figure 4:
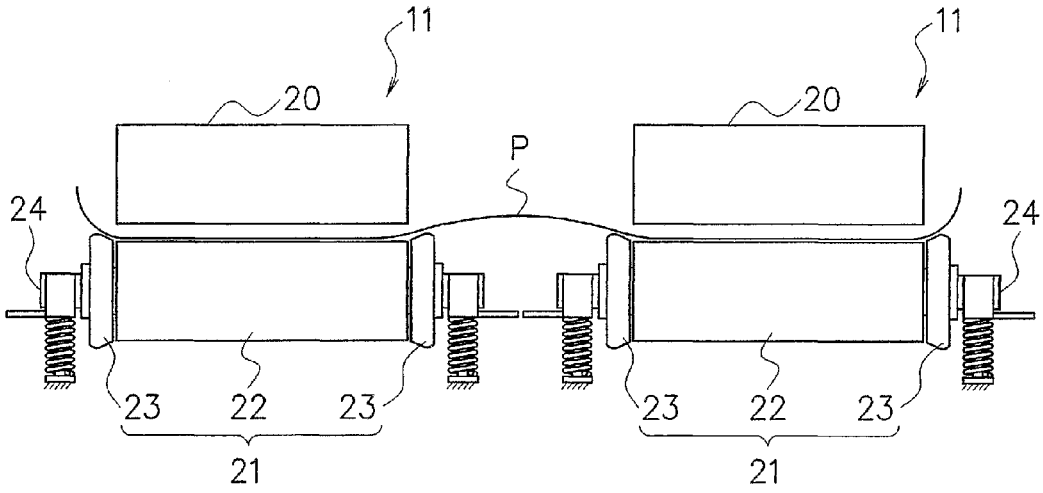
FIG. 4 A front view of the paper discharge device having two sets of paper discharge rollers according to the embodiment of the present invention.
Figure 5:
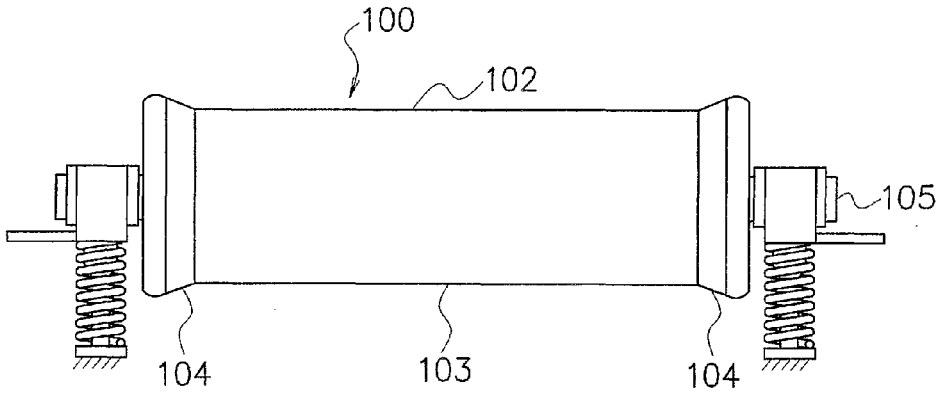
FIG. 5 A front view of the lower roller of the paper discharge roller proposed by the inventors or the present application prior to the present invention.
Figure 6:
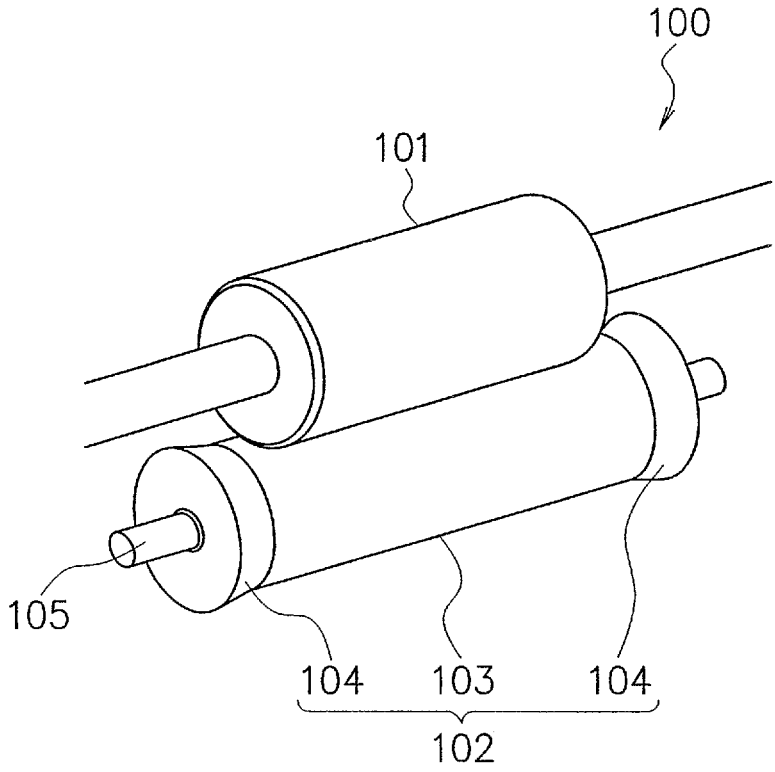
FIG. 6 A perspective view of the paper discharge roller proposed by the inventors or the present application prior to the present invention.

As shown in FIGS. 2 to 3, the paper discharge roller 11 in the first paper discharge unit 7 and the second paper discharge unit 13 has an upper roller 20 as a driving roller and a lower roller 21 as a driven roller. As shown in FIGS. 2 to 3, the lower roller 21 of the paper discharge roller 11 has a nip roller 22 at a central portion and forming rollers 23, 23 at both ends. The nip roller 22 has a cylindrical shape having approximately the same outer diameter of that of the upper roller 20 and has a length in a main scanning direction (direction orthogonal to the conveyance direction) longer than or approximately the same as that of the upper roller 20. The nip roller 22 is fixed to a driven shaft 24, and has a function of hold-conveying paper in cooperation with the upper roller 20. The forming roller 23 is arranged adjacent to both outer end surface of the nip roller 22. The forming roller is a separate member from the nip roller 22, and freely rotatably attached to the driven shaft 24. The shape is a tapered shape where the outer diameter is increased toward the outside, and has a function of forming side edges of the paper held and conveyed between the nip roller 22 and the upper roller 20 in a raised shape. In this manner, in the lower roller 21, the nip roller 22 at the center and the forming rollers 23, 23 at the both outer sides are separate members. With respect to the nip roller 22 which is rotated integrally with the driven shaft 24, the forming roller 23 is freely rotatable.

In the paper discharge roller 11, as the material or surface state of the upper roller 20 and the lower roller 21, especially the lower roller 21, for example, when the surface of a high nitrile NBR main body is ceramic coated, the contact area between the roller and the paper is small and ink is hardly attached to the roller. Thus more preferable effect is obtained.

As shown in FIGS. 2 to 3, the driven shaft 24 of the lower roller 21 of the paper discharge roller 11 is supported at both ends with bearings 25. Each bearing 25 is attached to a stationary part 27 of the apparatus via a spring 26. The nip roller 22 abuts the above-described upper roller 20, arranged in a predetermined position, via a predetermined pressing force with the spring 26.

As shown in FIG. 4, the first paper discharge unit 7 and the second paper discharge unit 13 in the present embodiment are provided with two sets of the paper discharge rollers 11 formed with the upper roller 20 and the lower roller 21 having the above-described structure, in axially-corresponding arrangement. Note that in FIG. 4, for the sake of convenience of illustration, an interval, larger than a required interval to hold the paper P, is shown between the upper roller 20 and the lower roller 21. Upon paper discharge, by holding and conveying the paper P between the upper roller 20 as a driving roller and the lower roller 21 as a driven roller, the paper is deformed in an approximately W shape in a plane orthogonal to the conveyance direction of the paper P. That is, the both side edges of the paper parallel to the conveyance direction are deformed to be raised upward along the forming roller 23 having an outer diameter larger than that of the nip roller 22 and the upper roller 20. The paper P as a hole is formed in a wavy shape. With this forming, the paper P has a strong body. The discharged paper P accurately arrives at a predetermined position on the paper discharge tray 10, 14, or stacked in an appropriate state on the paper discharge tray 10, 14. That is, it is possible to form the paper P in a predetermined shape and discharge it having a strong body by holding and conveying the paper where an image has been formed between the both rollers 20 and 21, and to improve floatage to prevent paper discharge failure or degradation of paper discharge stacking.

According to the present embodiment, the lower roller 21 to form the both side edges of the paper P in a predetermined shape while holding and conveying the paper P is formed with the central nip roller 22 having a comparatively small diameter and the both ends forming rollers 23, 23 having a comparatively large diameter. These rollers are separated from each other and independently rotatable. Note that since the conveyance speed of the held and conveyed paper P is constant, and the liner velocity of the paper P with respect to the nip roller 22 and that with respect to the forming roller 23 are the same, the number of revolutions of the forming roller 23 having a relatively large outer diameter is smaller than that of the nip roller 22 having the relatively small outer diameter. Accordingly, the friction between the forming roller 23 and the paper P is lower than conventional art, and attachment and accumulation of ink or the like with respect to the forming roller 23 is suppressed. Accordingly, inconvenience of contamination of the paper P with ink or the like upon paper discharge is unlikely.

In the above-described embodiment, in the first paper discharge unit 7 to perform face-up discharge and the second paper discharge unit 13 to perform face-down discharge, the lower roller 21 formed with the nip roller 22 and the forming roller 23 is a driven roller, and the upper roller 20 in contact with the nip roller 22 is a driving roller. It may be reversely arranged such that the lower roller 21 formed with the nip roller 22 and the forming roller 23 is a driving roller, and the upper roller 20 in contact with the nip roller 22 is a driven roller.

Further, in single-side printing, it is more preferable that upon discharge, with the image surface directed upward, to the first paper discharge unit 7 (face-up discharge), the lower roller 21 formed with the nip roller 22 and the forming roller 23 is a driving roller in that the friction with respect to the image surface is reduced. Further, it is more preferable that in the single-sided printing, upon discharge, with the image surface directed downward, to the second paper discharge unit 13 (face-down discharge), the lower roller 21 formed with the nip roller 22 and the forming roller 23 is driven roller in that the friction with respect to the image surface is reduced.

In the above-described embodiment, the shape of the peripheral surface of the forming roller 23 is a tapered surface where the outer diameter is enlarged toward outside. However, the shape of the peripheral surface of the forming roller is not limited to this shape. That is, the forming roller may have any shape as long as its outer diameter is larger than that of the nip roller 22 such that the forming roller is arranged on the both sides of the nip roller 22 and deforms the both side edges of the paper upward. However, when the shape is an ordinary cylindrical shape, it is preferable that the corner close to the nip roller 22 is curve processed in the point to reduce load with respect to the paper.

In the above-described embodiment, the image forming apparatus 1 using an ink-jet apparatus has been described. However, the image forming apparatus having the paper discharge roller 11 in the present embodiment and the paper discharge device using the paper discharge roller is not limited to the image forming apparatus using an ink-jet apparatus. For example, a stencil printing apparatus and other printing apparatuses, an electronic copying apparatus and the like are available.

DESCRIPTION OF REFERENCE NUMERALS IN THE DRAWINGS

1 . . . image forming apparatus
3 . . . conveyance passage
7 . . . first paper discharge unit as paper discharge device
8 . . . belt conveyance mechanism as conveyance unit
9 . . . ink-jet apparatus as image forming unit
10, 14 . . . paper discharge tray
13 . . . second paper discharge unit as paper discharge device
20 . . . upper roller
21 . . . lower roller
22 . . . nip roller
23 . . . forming roller
24 . . . driven shaft

The invention claimed is:

1. A paper discharge device comprising:

a paper discharge roller including an upper roller and a lower roller, one of which is a driving roller, wherein the lower roller has a nip roller, fixed to a shaft, that holds paper between the nip roller and the upper roller, and forming rollers, rotatable freely with respect to the shaft, having an outer diameter larger than that of the nip roller and arranged on two sides of the nip roller without contacting the upper roller, and wherein the upper roller and the lower roller hold and convey the paper such that the paper is formed in a predetermined shape and is discharged.

2. The paper discharge device according to claim 1, wherein the upper roller has an outer diameter and a length in a direction orthogonal to a conveyance direction;

the nip roller has a length in the direction orthogonal to the conveyance direction to form a cylindrical shape and the outer diameter of the nip roller is substantially same as that of the upper roller so as to convey the paper in cooperation with the upper roller, and the length of the nip roller in the direction orthogonal to the conveyance direction is longer or substantially same as that of the upper roller; and the forming roller has a tapered shape where the outer diameter is increased toward an outside thereof so as to form a side edge of the paper in a raised shape while the paper is held and conveyed between the nip roller and the upper roller.

3. The paper discharge device according to claim 2, wherein two sets of the paper discharge rollers, each set being formed with the upper roller and the lower roller, are respectively provided with axial lines of the upper roller and the lower roller corresponding with each other, and wherein the paper is deformed in a substantially W shape in a plane orthogonal to the conveyance direction and the two sets of the paper discharge rollers hold and convey the paper.

4. The paper discharge device according to claim 1, wherein the forming roller has a tapered portion with an inner edge directly facing the nip roller, the tapered portion gradually enlarging the outer diameter from the inner edge toward an outside thereof and being arranged outside the upper roller.

5. The paper discharge device according to claim 1, wherein the nip roller integrally rotates on the shaft.

* * * * *